US009605334B2

(12) United States Patent
Ishida et al.

(10) Patent No.: US 9,605,334 B2
(45) Date of Patent: Mar. 28, 2017

(54) HIGHLY HEAT-RESISTANT AND HIGH-STRENGTH RH-BASED ALLOY AND METHOD FOR MANUFACTURING THE SAME

(75) Inventors: Kiyohito Ishida, Sendai (JP); Yoshikazu Takaku, Sendai (JP); Toshihiro Omori, Sendai (JP)

(73) Assignee: TANAKA KIKINZOKU KOGYO K.K., Tokyo (JP)

( * ) Notice: Subject to any disclaimer, the term of this patent is extended or adjusted under 35 U.S.C. 154(b) by 320 days.

(21) Appl. No.: 14/345,424

(22) PCT Filed: Apr. 16, 2012

(86) PCT No.: PCT/JP2012/060254
§ 371 (c)(1),
(2), (4) Date: Mar. 18, 2014

(87) PCT Pub. No.: WO2013/065340
PCT Pub. Date: May 10, 2013

(65) Prior Publication Data

US 2014/0345758 A1 Nov. 27, 2014

(30) Foreign Application Priority Data

Nov. 4, 2011 (JP) ..... 2011-241940

(51) Int. Cl.
*C22C 5/04* (2006.01)
*C22F 1/14* (2006.01)

(52) U.S. Cl.
CPC . *C22F 1/14* (2013.01); *C22C 5/04* (2013.01)

(58) Field of Classification Search
CPC ..... C22C 5/04
(Continued)

(56) References Cited

U.S. PATENT DOCUMENTS 6,071,470 A 6/2000 Koizumi et al. ..... 420/461
8,551,265 B2 10/2013 Ishida et al. ..... 148/674
(Continued)

FOREIGN PATENT DOCUMENTS

JP H8-311584 11/1996
JP 2000-290741 10/2000
(Continued)

OTHER PUBLICATIONS

EP12846016 Search Report and Written Opinion.
(Continued)

*Primary Examiner* — Brian Walck
(74) *Attorney, Agent, or Firm* — Roberts & Roberts, LLP

(57) ABSTRACT

The present invention is a heat-resistant material comprising a Rh-based alloy, wherein the Rh-based alloy is a high heat-resistant and high strength alloy comprising a Rh-based alloy where Al and W as essential additive elements are added to Rh (0.2 to 15.0 mass % of Al, 15.0 to 45.0 mass % of W and Rh as the remainder), and a γ' phase ($Rh_3$ (Al, W)) having an $L1_2$ structure is dispersed as a strengthening phase in a matrix. The Rh-based alloy of the present invention can be further improved in workability and high temperature oxidation characteristics by optionally adding B, C, Mg, Ca, Y, La or misch metals, Ni, Co, Cr, Fe, Mo, Ti, Nb, Ta, V, Zr, Hf, Ir, Re, Pd, Pt or Ru as an additive element. The Rh-based alloy of the present invention is a heat-resistant material having excellent high-temperature-resistant characteristics and a good balance of factors such as weight.

8 Claims, 3 Drawing Sheets

(58) Field of Classification Search
USPC ..... 148/405, 430, 678; 420/462
See application file for complete search history.

(56) References Cited

U.S. PATENT DOCUMENTS

| | | | | |
|---|---|---|---|---|
| 2003/0079810 | A1 | 5/2003 | Jackson et al. | |
| 2003/0136478 | A1 | 7/2003 | Mitarai et al. | 148/426 |
| 2008/0102306 | A1 | 5/2008 | Gorman et al. | |
| 2008/0185078 | A1 | 8/2008 | Ishida et al. | 148/674 |
| 2008/0206090 | A1 | 8/2008 | Ishida et al. | 420/461 |
| 2010/0059146 | A1 | 3/2010 | Sato et al. | 148/530 |
| 2014/0007995 | A1 | 1/2014 | Ishida et al. | 148/674 |

FOREIGN PATENT DOCUMENTS

| | | |
|---|---|---|
| JP | JP2008-045176 A | 2/2008 |
| JP | 2010-65547 | 3/2010 |
| WO | WO2007-032293 | 3/2007 |
| WO | WO2007-091576 | 8/2007 |

OTHER PUBLICATIONS

Komienko, K.E., et al; "Alloys and phase equilibria in the Al—Ti—Rh system. I. Solidus surface of the TiRh—Rh—AlRh partial System". Powder Metallurgy and Metal Ceramics; Kluwer Academic Publishers-Consultants Bureau, NE vol. 46, No. 9-10; Sep. 1, 2007 (Sep. 1, 2007), pp. 454-460, XP019579790, ISSN: 1573-9066.

Lattice Constant

| γ | γ' | Mismatch |
|---|---|---|
| 3.825 | 3.827 | 0.05 |

HIGHLY HEAT-RESISTANT AND HIGH-STRENGTH RH-BASED ALLOY AND METHOD FOR MANUFACTURING THE SAME

BACKGROUND OF THE INVENTION

Field of the Invention

The present invention relates to a Rh-based heat-resistant alloy suitable for a member of jet engines, gas turbines and the like, and to a method for manufacturing the same, and particularly relates to an alloy that has heat resistance and oxidation resistance superior to those of conventional Ni-based alloys and can maintain required strength even upon exposure to severe high temperature atmosphere.

Description of the Related Art

As for functional components of gas turbines, aircraft engines, chemical plants, automobile engines, turbocharger rotors and the like and members of a high-temperature furnace and the like, strength under a high-temperature environment and excellent oxidation resistance are required. As this type of high-temperature-resistant materials, Ni-based alloys and Co-based alloys have been conventionally used.

Strengthening mechanism for a Ni-based alloy as a heat-resistant material is basically a precipitation strengthening, which comprising dispersing a γ' phase ($Ni_3(Al, Ti)$) having an $L1_2$ structure as a strengthening phase in the matrix alloy. Since the γ' phase exhibits inverse temperature dependence where strength increases with an increase in temperature, the phase imparts excellent high temperature strength and high temperature creep characteristics to create a Ni-based alloy suitable for heat-resistant applications such as a rotor blade of a gas turbine and a turbine disk. On the other hand, strengthening mechanism for a Co-based alloy as a heat-resistant material uses solid solution strengthening and precipitation strengthening of carbides. Systems containing a large amount of Cr have excellent corrosion resistance and oxidation resistance and good abrasion resistance, and are therefore used for members such as a stationary blade and a combustor.

More recently, in various heat engines, improvement in thermal efficiency has strongly been required for improving fuel economy and reducing environmental burdens and therefore heat resistance required for heat engine component material has become more severe. Hence, development of a novel heat-resistant material replacing conventional Ni-based and Co-based alloys has been studied.

So far, many research reports regarding novel heat-resistant alloys have been published. The present inventors have also disclosed heat-resistant materials made of the following alloys as new heat-resistant alloys replacing Ni-based alloys: a Co-based alloy in which a γ' phase intermetallic compound ($Co_3(Al, W)$) having an $L1_2$ structure similar to that of a Ni-based heat-resistant alloy is dispersed; and an Ir-based alloy providing a precipitation strengthening effect based on a γ' phase intermetallic compound ($Ir_3(Al, W)$) having an $L1_2$ structure (Patent Literatures 1 and 2).

PRIOR ART DOCUMENTS

Patent Literature

[Patent Literature 1] International Publication No. WO2007-032293

[Patent Literature 2] International Publication No. WO2007-091576

SUMMARY OF THE INVENTION

Problems to be Solved by the Invention

For the application of heat-resistant materials to functional components of a gas turbine and members of a high-temperature furnace and the like, it is required that high-temperature characteristics such as high temperature strength and oxidation resistance are excellent. However, factors such as weight (specific gravity) and material cost are also emphasized in terms of practical use. Meanwhile, for novel heat-resistant materials of prior art, studies of improvement in high-temperature characteristics have been given a priority and studies of other factors were insufficient. Thus, an object of the present invention is to provide a heat-resistant material having not only excellent high-temperature characteristics but also good balance of factors such as weight.

Means for Solving the Problem

The present invention for solving the above problem is a heat-resistant material comprising a Rh-based alloy that is a high heat-resistant and high strength alloy comprising a Rh-based alloy where Al and W as essential additive elements are added to Rh. The Rh-based alloy comprises 0.2 to 15.0 mass % of Al and 15.0 to 45.0 mass % of W with the remainder being Rh, and a γ' phase ($Rh_3(Al, W)$) having an $L1_2$ structure is dispersed as an essential strengthening phase in a matrix.

The heat-resistant material according to the present invention comprises a Rh (rhodium)-based alloy. The reason why Rh is applied is that Rh is one of precious metals and has a high melting point (1966° C.) and excellent corrosion resistance (oxidation resistance). Therefore, it is considered that its chemical stability at high temperature is much better than that of conventional Ni-based alloys. Further, Rh has a specific gravity of about 12, which is lower than that of Ir (specific gravity: about 22) and relatively close to that of Ni (specific gravity: about 9). Thus, Rh-based alloy can contribute to a weight reduction of members as compared to the above conventional Ir-based heat-resistant alloys.

In the present invention, a γ' phase ($Rh_3(Al, W)$, which may be simply referred to as γ' phase hereinafter) having an $L1_2$ structure is dispersed as a strengthening factor of a Rh-based alloy. Precipitation strengthening with the γ' phase is the same as the case of the above conventional Ir-based alloy. The γ' phase is excellent in high temperature stability because of inverse temperature dependence for strength, and Rh itself is also excellent in high temperature strength. Therefore, the Rh-based heat-resistant alloy according to the present invention maintains excellent high-temperature characteristics even when exposed to a much higher high temperature atmosphere compared with Ni-based heat-resistant alloys.

The present invention will be described in detail below. The present invention is a Rh-based alloy with Al (aluminum) and W (tungsten) as alloy elements and comprising 0.2 to 15.0 mass % of Al and 15.0 to 45.0 mass % of W. Heretofore, it has not been known that a γ' phase is precipitated in an alloy in which Al and W are added to Rh. The amounts of Al and W to be added are set to the above ranges in order to precipitate the γ' phase that can function as a strengthening phase. The numerical ranges are revealed as a result of studies made by the present inventors.

In other words, Al is not only a main constituent element of the γ' phase but also a component necessary for precipitation and stabilization of the γ' phase and also contributes to improvement in oxidation resistance. Al at less than 0.2 mass % precipitates no γ' phase or on γ' phase in an amount insufficient to contribute to improvement in high temperature strength. On the other hand, with an increase of the Al concentration, the ratio of the γ' phase is lowered to produce a B2 type intermetallic compound (RhAl, which may sometimes be referred to as B2 phase hereinafter). Further, since excessive addition of Al coarsens a B2 phase to become fragile and therefore strength of the alloy reduces, the upper limit of Al content is set to 15 mass %.

W is also a main constituent element of the γ' phase, and also has an effect of solid solution strengthening of an alloy matrix. Also, when W is added at less than 15 mass %, the γ' phase for improving high temperature strength is not precipitated. Further, excessive addition of W at more than 45 mass % facilitates formation of a phase mainly composed of W having a large specific gravity, and therefore segregation is likely to occur.

As described above, the Rh-based alloy according to the present invention improves high temperature strength with proper dispersion of the γ' phase, but formation of other phases cannot be completely eliminated. When Al and W are added within the above-described range, a B2 phase or a D019 type intermetallic compound ($Rh_3W$, which may be referred to as a D019 phase hereinafter) may be precipitated in addition to the γ' phase depending on the composition. However, when the contents of Al and W are within the above range, high temperature strength is secured even if these precipitates other than the γ' phase are present. These precipitation phases also have the effect of strengthening materials. As for distribution of these precipitates, only the γ' phase is precipitated in the range of 0.2 to 2.0 mass % of Al and 15.0 to 30.0 mass % of W (0.5 mass % or more is more preferable for effective precipitation of the γ' phase). On the other hand, in the range of more than 2.0 and 15.0 mass % or less of Al and more than 30.0 and 45.0 mass % or less of W, a B2 phase and/or a D019 phase as well as the γ' phase are precipitated. In the either range, the γ' phase as a strengthening phase is present, which contributes to the improvement in high temperature strength.

It is preferable that the γ' phase, B2 phase and D019 phase as precipitates have a particle size of 3 nm to 1 μm and that the amount of their precipitation is 20 to 85 volume % in total (relative to the entire alloy). The precipitates with a particle size of 3 nm or more provide the precipitation strengthening effect, but coarse precipitates with a particle size of more than 1 μm lower the effect. Further, the amount of precipitation of 20 volume % or more is necessary for obtaining a sufficient precipitation strengthening effect while it is concerned that an excessive amount of precipitation of more than 85 volume % deteriorates ductility. In order to obtain suitable particle size and amount precipitation, it is preferable that a stepwise aging treatment is performed at a predetermined temperature range in the manufacturing method described later.

An additive element may be added to the heat resistant Rh-based alloy according to the present invention for further improvement in high-temperature characteristics and additional improvement in characteristics. Such additive elements are classified into the two following groups.

Group I is a group consisting of B, C, Mg, Ca, Y, La and misch metals. B is an alloy component that segregates at a crystal grain boundary to strengthen the grain boundary, thereby contributing to improvement of high temperature strength. The effect with addition of B becomes significant at 0.001 mass % or more while an excessive addition is not preferable for workability, and therefore the upper limit is set to 1.0 mass % (preferably, 0.5 mass %). As with B, C is effective for the grain boundary strengthening, and further C is precipitated as a carbide to improve high temperature strength. Such an effect can be seen with the addition of C at 0.001 mass % or more. However, since excessive addition is not preferable for workability and toughness, the upper limit of C content is set to 1.0 mass % (preferably 0.8 mass %). Mg has an effect of suppressing embrittlement of grain boundaries, and Mg at 0.001 mass % or more makes the addition effect significant. However, since excessive addition causes formation of a deleterious phase, the upper limit was set to 0.5 mass % (preferably 0.4 mass %). Ca is an alloy component having effects of deoxidation and desulfurization, and contributes to improvement in ductility and workability. The addition effect of Ca becomes significant at 0.001 mass % or more, but the upper limit was set to 1.0 mass % (preferably 0.5 mass %) since excessive addition deteriorates workability. All of Y, La and misch metals are effective components for improving oxidation resistance, and addition effect is exhibited at 0.01 mass % or more, but their upper limits were set to 1.0 mass % (preferably 0.5 mass %) since excessive addition of each adversely affects structural stability.

One or more of the above additive elements of Group I are added in a total amount of 0.001 to 2.0 mass %. However, when these additive elements are added, the content of Rh is set to 50 mass % or more since a low content of Rh in the alloy makes it impossible to utilize superior high-temperature characteristics of Rh.

Group II is a group consisting of Co, Ni, Cr, Ti, Fe, V, Nb, Ta, Mo, Zr, Hf, Ir, Re, Pd, Pt and Ru. In these additive elements, one or more of them are added in a total amount of 0.1 to 48.9 mass %. As is the case in the additive elements of Group I, the content of Rh is set to 50 mass % or more.

In a Rh-based alloy where an additive element of Group II is added, a γ' phase ($(Rh, X)_3(Al, W, Z)$) having an $L1_2$ structure is also precipitated and dispersed as a strengthening phase, wherein X is Co, Fe, Cr, Ir, Re, Pd, Pt and/or Ru, and Z is Mo, Ti, Nb, Zr, V, Ta and/or Hf. Ni is included in both X and Z. This γ' phase ($(Rh, X)_3(Al, W, Z)$), in which the elements X and Z form a solid solution with $Rh_3(Al, W)$, has the same crystal structure as the structure of the γ' phase ($Rh_3(Al, W)$) in the Rh—Al—W ternary alloy.

Also in a Rh-based alloy where an additive element of Group II is added, an intermetallic compound other than γ' phases may be precipitated depending on the amount of Al and W to be added. This intermetallic compound is a B2 type intermetallic compound ($(Rh, X)(Al, W, Z)$) or D019 type intermetallic compound ($(Rh, X)_3W$)), and these compounds have the same crystal structure as the B2 phase (RhAl) or D019 phase ($Rh_3W$) in the Rh—Al—W ternary alloy (X and Z are denoted as defined above). These B2 and D019 phases also act as a strengthening phase when Al and W are within the appropriate range (Al: 0.2 to 15.0 mass %, W: 15.0 to 45.0 mass %). As for distribution of these precipitates, only the γ' phase is precipitated in the range of 0.2 to 2.0 mass % of Al and 15.0 to 30.0 mass % of W (0.5 mass % or more is more preferable for effective precipitation of the γ' phase). On the other hand, in the range of more than 2.0 and 15.0 mass % or less of Al and more than 30.0 and 45.0 mass % or less of W, the B2 phase and/or D019 phase as well as the γ' phase are precipitated. In either range, the γ' phase as a strengthening phase is present, which most contributes to the improvement in high temperature strength.

Ni and Co act to strengthen a matrix (γ phase) and form solid solution in all proportions with the γ phase, so that a two-phase structure of (γ+γ') is obtained over a wide composition range. Further, since Ni and Co are replaced with Rh of the γ' phase, a smaller amount of a precious metal Ir is used to lower the cost. The addition effect is exhibited in the content of 0.1 mass % or more for Ni and 0.1 mass % or more for Co while excessive addition decreases a melting point and a solid solution temperature of the γ' phase to impair the excellent high-temperature characteristics of the Rh-based alloy. Therefore, the upper limit of the content of Ni and Co was set to 48.9 mass % (preferably 40 mass %) so as not to lower the Rh content to 50 mass % or less.

Cr is an alloy component creating a dense oxide coating on the surface of the Rh-based alloy to improve oxidation resistance, and contributes to improvement in high temperature strength and corrosion resistance. This effect becomes significant when 0.1 mass % or more of Cr is added. However, since excessive addition causes workability deterioration, the upper limit was set to 15 mass % (preferably 10 mass %).

Fe is also replaced with Rh, and has an effect of improving workability. The addition effect becomes significant at 0.1 mass % or more. However, since excessive addition causes destabilization of the texture in a high temperature range, the upper limit in the case of the addition is set to 20 mass % (preferably 5.0 mass %).

Mo is an effective alloy component for stabilization of the γ' phase and solid solution strengthening of the matrix, and Mo at 0.1 mass % or more provides the addition effect. However, since excessive addition causes deterioration in workability, the upper limit was set to 15 mass % (preferably 10 mass %).

Each of Ti, Nb, Zr, V, Ta and Hf is an effective alloy component for stabilization of the γ' phase and improvement in high temperature strength. The addition effect is exhibited at the following contents: Ti: 0.1 mass % or more, Nb: 0.1 mass % or more, Zr: 0.1 mass % or more, V: 0.1 mass % or more, Ta: 0.1 mass % or more, Hf: 0.1 mass % or more. However, since excessive addition causes formation of a deleterious phase and a decrease of the melting point, the upper limits were set to the following contents: Ti: 10 mass %, Nb: 15 mass %, Zr: 15 mass %, V: 20 mass %, Ta: 25 mass %, Hf: 25 mass %.

Ir is an effective alloy component for solid solution strengthening of the matrix, and is replaced with Rh of the γ' phase. While 0.1 mass % or more of Ir exhibits the addition effect, the upper limit in the case of addition is set to 15 mass % (preferably 5.0 mass %) since excessive addition increases the specific gravity of the alloy.

Re, Pd, Pt and Ru are effective alloy components for improving oxidation resistance, and any of them provides the addition effect that becomes significant at 0.1 mass % or more. However, since excessive addition induces formation of a deleterious phase, the upper limit of the amount to be added was set to 25 mass % (preferably 10 mass %) for Re and Pt and 15 mass % (preferably 10 mass %) for Pd and Ru.

In manufacture of the Rh-based alloy according to the present invention, any method of a usual casting process, unidirectional solidification, molten metal forging and a single crystal method can be used. Then, heat treatment is performed for γ' phase precipitation. In this heat treatment, a Rh alloy manufactured with various melting methods is heated to the temperature range of 900 to 1700° C. (preferably 1100 to 1600° C.). In this treatment, heating time of 30 minutes to 100 hours is preferable.

Effects of the Invention

The Rh alloy according to the present invention is much superior in high-temperature characteristics such as high temperature strength and oxidation resistance as compared with conventionally used Ni-based heat-resistant alloys. In addition, the alloy according to the present invention is more advantageous than Ir-based alloys in terms of weight and cost, and has potential for practical use as a novel heat-resistant alloy.

DETAILED DESCRIPTION OF THE PREFERRED EMBODIMENTS

Hereinafter, a preferred example of the present invention is described.

First Embodiment

The Rh-based alloys having the composition listed in Table 1 were melted by arc melting in an inert gas atmosphere and casted into an ingot. Test pieces cut out from the ingot were subjected to a heat treatment at 1300° C. as an aging treatment for forming precipitates. Then, structural observation and identification of phase constitution were performed for each test piece. Further, hardness was measured for each alloy with a Vickers test (load: 500 kgf, pressurizing time: 10 seconds, room temperature). The results of these tests are shown together in Table 1.

TABLE 1

| | Alloy Composition (wt %) | | | Hardness | Phase |
|---|---|---|---|---|---|
| | Rh | Al | W | (Hv) | Constitution |
| Example 1 | 72.80 | 1.20 | 26.00 | 430 | γ, γ' |
| Example 2 | 74.83 | 0.72 | 24.45 | 440 | γ, γ' |
| Example 3 | 65.99 | 13.00 | 21.01 | 426 | γ, γ', B2 |
| Example 4 | 70.57 | 0.70 | 28.73 | 410 | γ, γ', $D0_9$ |
| Example 5 | 68.81 | 1.68 | 29.50 | 452 | γ', $D0_{19}$, B2 |
| Comparative Example 1 | 99.8 | 0.1 | 0.1 | 240 | γ |
| Comparative Example 2 | 89.8 | 0.2 | 10 | 245 | γ, B2 |
| Comparative Example 3 | 30 | 20.00 | 50.00 | 900 | $D0_{19}$ + B2 + W |

In Table 1, only a γ' phase was detected as a precipitate in Examples 1 and 2 with relatively small amounts of Al and W added. When the ratio of Al and W is increased, a B2 layer phase and/or D019 phase as well as the γ' phase are precipitated in the structure of the precipitates (Examples 3 to 5). On the other hand, when the concentrations of Al and W are too low (Comparative Example 1), precipitates (γ' phase, etc.) are not observed, and thus the test piece is composed only of the matrix (γ phase). Also, even when the amounts of Al and W added are increased in some degree, no γ' phase is seen (Comparative Example 2). Further, when the concentrations of Al and W are too high (Comparative Example 3), the B2 phase and D019 phase are precipitated while the γ' phase is not generated.

As for the effect of the γ' phase precipitation, appropriate hardness improvement is confirmed in Examples 1 to 5 in which the γ' phase is precipitated. In contrast, Comparative Examples 1 and 2 with a low concentration of Al and W showed that the hardness remained low because the γ' phase was not present. Meanwhile, since the concentration of Al and W is too high in Comparative Example 3, the hardness is high or rather too high, which is not preferred in view of brittleness.

Figure 1:
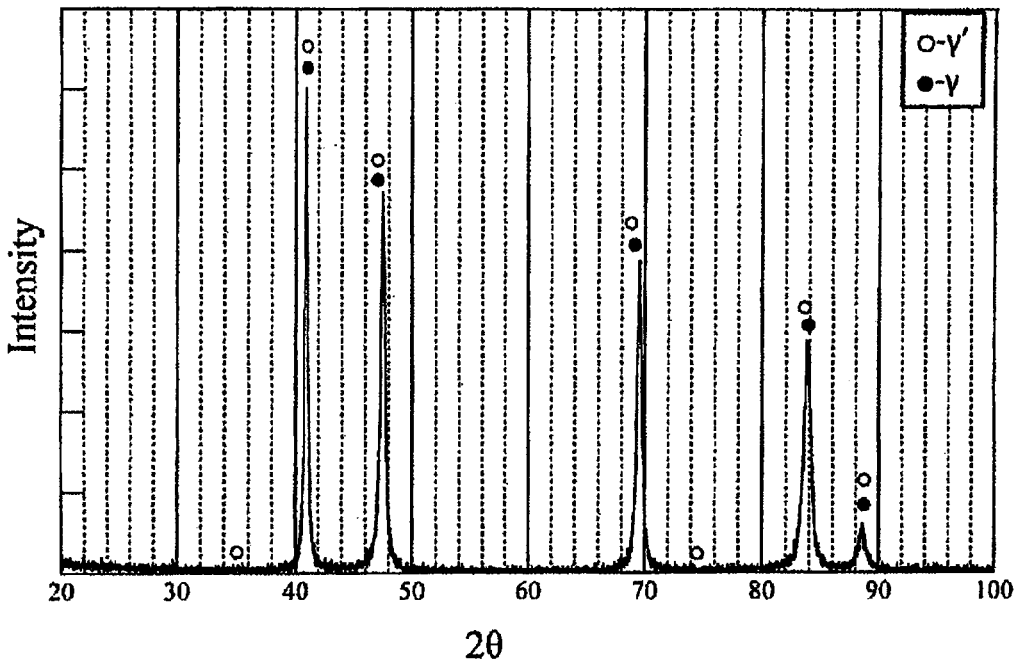
[FIG. 1] XRD of the Rh-based alloy of Example 1 (Rh-1.2 mass % Al-26 mass % W).
Figure 3:
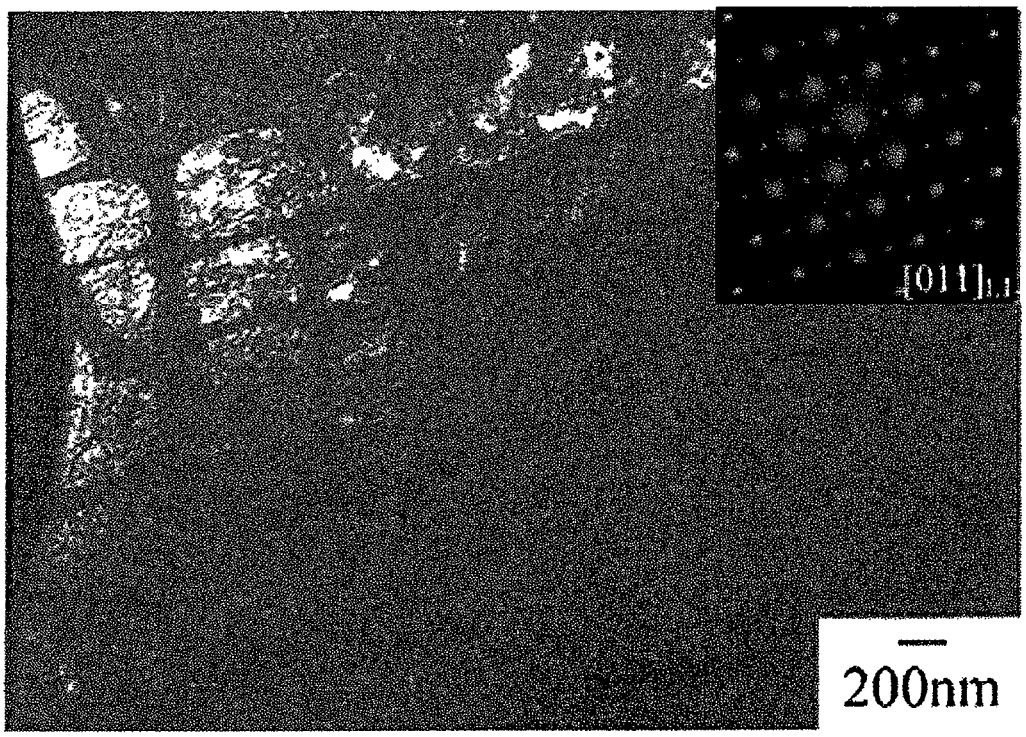
[FIG. 3] An electron micrograph of the Rh-based alloy of Example 2 (Rh-0.72 mass % Al-24.5 mass % W).

Then, XRD analysis and a high-temperature oxidation test were performed for the Rh-based alloy of Example 1 (Rh-1.2 mass % Al-26 mass % W). First, FIG. 1 shows the XRD results of the Rh-based alloy of Example 1. The Figure reveals that the alloy of Example 1 is composed only of the matrix (γ phase) and the γ' phase. Further, based on this result, a mismatch between the γ and γ' phases was examined and then a positive mismatch of 0.05% was confirmed. In addition, an electron micrograph of the structure of Example 2 (Rh-0.72 mass % Al-24.5 mass % W) is shown in FIG. 3.

Figure 2:
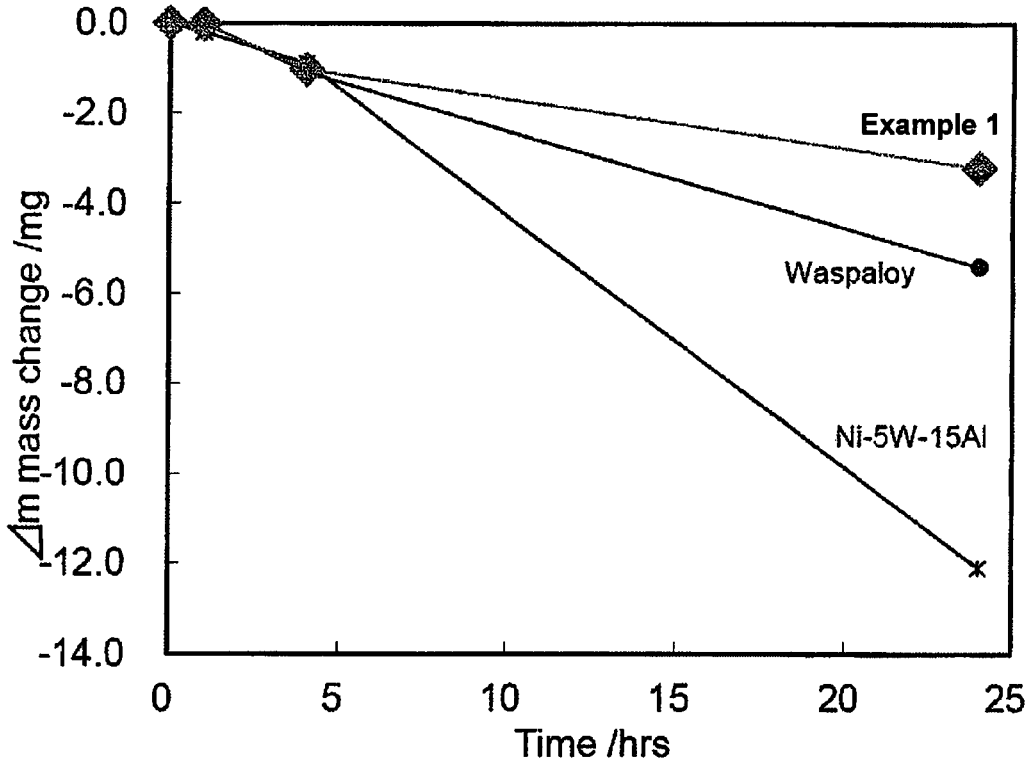
[FIG. 2] A diagram showing the results of the high-temperature oxidation test of the Rh-based alloy of Example 1 (Rh-1.2 mass % Al-26 mass % W).

In a high-temperature oxidation test, test pieces were cut out to the dimension of 2 mm×2 mm×2 mm, and then heat-treated for 1, 4 and 24 hours in air at 1200° C., and then the change in weight was measured. In this high-temperature oxidation test, the same test was performed for the following alloys as Ni-based heat-resistant alloys for comparison: Ni-6.7 mass % Al-15 mass % W; and Waspaloy (Cr: 19.5 mass %, Mo: 4.3 mass %, Co: 13.5 mass %, Al: 1.4 mass %, Ti: 3 mass %, C: 0.07 mass % (the remainder is Ni)). The results are shown in FIG. 2. As a result, it is found that the Rh-based alloys of this embodiment have much better high-temperature oxidation resistance than the Ni-based heat-resistant alloys.

Second Embodiment

In this embodiment, alloys were manufactured by adding various additive elements to a Rh—Al—W alloy having the basic composition. The additive elements are elements belonging to Groups I and II as described above, and the alloys listed in Tables 2 and 3 were manufactured. In the manufacture of these Rh-based alloys, as with First Embodiment, test pieces were cut out from an ingot that had been arc-melted and cast in an inert gas atmosphere, and then the test pieces were subjected to aging treatment. Then, phase constitution was confirmed with structure observation, and hardness measurement was performed. The results are shown together in Tables 2 and 3.

TABLE 2

| | Alloy Composition (wt %) | | | | | | |
|---|---|---|---|---|---|---|---|
| | Rh | Al | W | Additive Element | Amount To Be Added | Hardness (Hv) | Phase Constitution |
| Example 6 | 74.81 | 0.72 | 24.45 | B | 0.02 | 440 | γ, γ' |
| Example 7 | 76.41 | 2.57 | 21.00 | | | 450 | γ, γ', B2 |
| Example 8 | 70.56 | 0.70 | 28.72 | | | 575 | γ, γ', $D0_{19}$ |
| Example 9 | 68.80 | 1.68 | 29.50 | | | 529 | γ', $D0_{19}$, B2 |
| Example 10 | 74.78 | 0.72 | 24.44 | C | 0.06 | 554 | γ, γ', |
| Example 11 | 70.53 | 0.70 | 28.71 | | | 580 | γ, γ', $D0_{19}$ |
| Example 12 | 68.77 | 1.68 | 29.48 | | | 540 | γ', $D0_{19}$, B2 |
| Example 13 | 76.37 | 2.57 | 20.99 | | 0.07 | 560 | γ, γ', B2 |
| Example 14 | 74.53 | 0.71 | 24.36 | Y | 0.39 | 438 | γ, γ' |
| Example 15 | 70.30 | 0.70 | 28.62 | | | 440 | γ, γ', $D0_{19}$ |
| Example 16 | 68.54 | 1.68 | 29.39 | | 0.40 | 465 | γ', $D0_{19}$, B2 |
| Example 17 | 76.10 | 2.56 | 20.92 | | 0.42 | 423 | γ, γ', B2 |
| Example 18 | 74.75 | 0.72 | 24.43 | Mg | 0.11 | 420 | γ, γ' |
| Example 19 | 70.50 | 0.70 | 28.70 | | | 410 | γ, γ', $D0_{19}$ |
| Example 20 | 68.74 | 1.68 | 29.47 | | | 405 | γ', $D0_{19}$, B2 |
| Example 21 | 76.34 | 2.57 | 20.98 | | 0.12 | 414 | γ, γ', B2 |
| Comparative Example 6 | 25.00 | 20.00 | 50.00 | Mg | 5.00 | 500 | $D0_{19}$ + B2 + W |

TABLE 3

| | Alloy Composition (wt %) | | | | | | |
|---|---|---|---|---|---|---|---|
| | Rh | Al | W | Additive Element | Amount To Be Added | Hardness (Hv) | Phase Constitution |
| Example 22 | 71.18 | 0.68 | 23.26 | Cr | 4.87 | 587 | γ, γ' |
| Example 23 | 72.44 | 2.43 | 19.91 | | 5.21 | 567 | γ, γ', B2 |
| Example 24 | 67.20 | 0.67 | 27.35 | | 4.78 | 440 | γ, γ', $D0_{19}$ |
| Example 25 | 65.44 | 1.60 | 28.06 | | 4.90 | 529 | γ', $D0_{19}$, B2 |
| Example 26 | 66.21 | 0.64 | 21.64 | Ni | 11.51 | 425 | γ, γ' |
| Example 27 | 67.06 | 2.25 | 18.43 | | 12.26 | 453 | γ, γ', B2 |
| Example 28 | 62.60 | 0.62 | 25.48 | | 11.30 | 464 | γ, γ', $D0_{19}$ |
| Example 29 | 60.85 | 1.49 | 26.09 | | 11.57 | 479 | γ', $D0_{19}$, B2 |
| Example 30 | 71.46 | 0.69 | 23.35 | Ti | 4.50 | 614 | γ, γ' |
| Example 31 | 72.74 | 2.45 | 19.99 | | 4.82 | 469 | γ, γ', B2 |
| Example 32 | 67.46 | 0.67 | 27.46 | | 4.41 | 590 | γ, γ', $D0_{19}$ |
| Example 33 | 65.70 | 1.61 | 28.17 | | 4.53 | 526 | γ', $D0_{19}$, B2 |

TABLE 3-continued

| | Alloy Composition (wt %) | | | | | | |
|---|---|---|---|---|---|---|---|
| | Rh | Al | W | Additive Element | Amount To Be Added | Hardness (Hv) | Phase Constitution |
| Example 34 | 71.25 | 0.68 | 23.29 | V | 4.78 | 490 | γ, γ' |
| Example 35 | 72.52 | 2.44 | 19.93 | | 5.11 | 438 | γ, γ', B2 |
| Example 36 | 67.27 | 0.67 | 27.38 | | 4.68 | 470 | γ, γ', $D0_{19}$ |
| Example 37 | 65.51 | 1.60 | 28.09 | | 4.80 | 440 | γ', $D0_{19}$, B2 |
| Example 38 | 68.55 | 0.66 | 22.40 | Nb | 8.39 | 581 | γ, γ' |
| Example 39 | 69.59 | 2.34 | 19.13 | | 8.95 | 559 | γ, γ', B2 |
| Example 40 | 64.77 | 0.64 | 26.36 | | 8.22 | 422 | γ, γ', $D0_{19}$ |
| Example 41 | 63.01 | 1.54 | 27.02 | | 8.43 | 570 | γ', $D0_{19}$, B2 |
| Example 42 | 63.51 | 0.61 | 20.75 | Ta | 15.13 | 657 | γ, γ' |
| Example 43 | 64.15 | 2.16 | 17.63 | | 16.07 | 556 | γ, γ', B2 |
| Example 44 | 60.08 | 0.60 | 24.46 | | 14.86 | 637 | γ, γ', $D0_{19}$ |
| Example 45 | 58.35 | 1.43 | 25.02 | | 15.20 | 662 | γ', $D0_{19}$, B2 |
| Example 46 | 71.62 | 0.69 | 23.41 | Mo | 4.29 | 586 | γ, γ' |
| Example 47 | 72.92 | 2.45 | 20.04 | | 4.59 | 528 | γ, γ', B2 |
| Example 48 | 67.61 | 0.67 | 27.52 | | 4.20 | 474 | γ, γ', $D0_{19}$ |
| Example 49 | 65.85 | 1.61 | 28.23 | | 4.31 | 513 | γ', $D0_{19}$, B2 |
| Example 50 | 71.77 | 0.69 | 23.46 | Zr | 4.08 | 657 | γ, γ' |
| Example 51 | 73.08 | 2.46 | 20.09 | | 4.37 | 643 | γ, γ', B2 |
| Example 52 | 67.75 | 0.67 | 27.58 | | 4.00 | 623 | γ, γ', $D0_{19}$ |
| Example 53 | 65.99 | 1.61 | 28.29 | | 4.11 | 667 | γ', $D0_{19}$, B2 |
| Example 54 | 69.07 | 0.66 | 22.57 | Hf | 7.69 | 460 | γ, γ' |
| Example 55 | 70.15 | 2.36 | 19.28 | | 8.21 | 472 | γ, γ', B2 |
| Example 56 | 65.25 | 0.65 | 26.56 | | 7.54 | 442 | γ, γ', $D0_{19}$ |
| Example 57 | 63.49 | 1.55 | 27.22 | | 7.73 | 489 | γ', $D0_{19}$, B2 |
| Example 58 | 68.85 | 0.66 | 22.50 | Re | 8.00 | 378 | γ, γ' |
| Example 59 | 69.90 | 2.35 | 19.21 | | 8.54 | 364 | γ, γ', B2 |
| Example 60 | 65.04 | 0.65 | 26.47 | | 7.84 | 339 | γ, γ', $D0_{19}$ |
| Example 61 | 63.28 | 1.55 | 27.13 | | 8.04 | 373 | γ', $D0_{19}$, B2 |
| Example 62 | 50.91 | 0.49 | 16.64 | Pd | 31.96 | 563 | γ, γ' |
| Example 63 | 50.80 | 1.17 | 13.96 | | 33.53 | 578 | γ, γ', B2 |
| Example 64 | 48.34 | 0.48 | 19.68 | | 31.50 | 478 | γ, γ', $D0_{19}$ |
| Example 65 | 46.74 | 1.14 | 20.04 | | 32.08 | 637 | γ', $D0_{19}$, B2 |
| Example 66 | 68.58 | 0.66 | 22.41 | Pt | 8.35 | 552 | γ, γ' |
| Example 67 | 69.62 | 2.34 | 19.13 | | 8.91 | 567 | γ, γ', B2 |
| Example 68 | 64.80 | 0.65 | 26.38 | | 8.18 | 573 | γ, γ', $D0_{19}$ |
| Example 69 | 63.04 | 1.54 | 27.03 | | 8.39 | 593 | γ', $D0_{19}$, B2 |
| Example 70 | 71.46 | 0.69 | 23.35 | Ru | 4.50 | 425 | γ, γ' |
| Example 71 | 72.74 | 2.45 | 19.99 | | 4.82 | 423 | γ, γ', B2 |
| Example 72 | 67.46 | 0.67 | 27.46 | | 4.41 | 412 | γ, γ', $D0_{19}$ |
| Example 73 | 65.70 | 1.61 | 28.17 | | 4.53 | 444 | γ', $D0_{19}$, B2 |
| Example 74 | 66.18 | 0.63 | 21.63 | Co | 11.56 | 493 | γ, γ' |
| Example 75 | 67.02 | 2.25 | 18.42 | | 12.30 | 450 | γ, γ', B2 |
| Example 76 | 62.57 | 0.62 | 25.47 | | 11.34 | 546 | γ, γ', $D0_{19}$ |
| Example 77 | 60.82 | 1.49 | 26.08 | | 11.61 | 554 | γ', $D0_{19}$, B2 |
| Example 78 | 66.58 | 0.64 | 21.76 | Fe | 11.O2 | 594 | γ, γ' |
| Example 79 | 67.46 | 2.27 | 18.54 | | 11.73 | 537 | γ, γ', B2 |
| Example 80 | 62.94 | 0.63 | 25.62 | | 11.81 | 552 | γ, γ', $D0_{19}$ |
| Example 81 | 61.19 | 1.50 | 26.24 | | 11.O7 | 589 | γ', $D0_{19}$, B2 |
| Example 82 | 62.91 | 0.60 | 20.56 | Ir | 15.92 | 641 | γ, γ' |
| Example 83 | 62.91 | 0.60 | 20.56 | | 15.92 | 630 | γ, γ', B2 |
| Example 84 | 62.91 | 0.60 | 20.56 | | 15.92 | 660 | γ, γ', $D0_{19}$ |
| Example 85 | 62.91 | 0.60 | 20.56 | | 15.92 | 672 | γ, $D0_{19}$, B2 |
| Comparative Example 4 | 49.80 | 0.2 | 10 | V | 40.00 | 283 | γ, B2 |
| Comparative Example 5 | 69.80 | 0.1 | 0.1 | Co | 30.00 | 280 | γ |

As for the additive elements of Group I, it is presumed that they are added in a small amount. Thus, as long as an amount of Al and W added is appropriate, the precipitation of γ' phase can be observed. In addition, there was no significant change in the material structure because of the addition at small amounts. As for the additive element of Group II, the precipitation of the γ' phase is observed at appropriate amounts of Al and W added. Thereby, appropriate hardness improvement is confirmed.

INDUSTRIAL APPLICABILITY

The present invention is a Rh alloy having superior high-temperature characteristics such as high temperature strength and oxidation resistance as compared to Ni-based heat-resistant alloys. The present invention is suitable for members of gas turbines, aircraft engines, chemical plants, automobile engines such as turbocharger rotors and a high-temperature furnace and the like. In addition, since the alloy according to the present invention has high strength and elasticity and excellent corrosion and abrasion resistance, it is also used as materials such as build-up materials, spiral springs, springs, wires, belts and cable guides.

What is claimed is:

1. A heat-resistant material comprising a Rh-based alloy, wherein the Rh-based alloy consists of Rh, Al, and W, wherein Al is present in an amount of 0.2 to 15.0 mass % and W is present in an amount from 15.0 to 45.0 mass %; and a γ' phase ($Rh_3$(Al, W)) having an $L1_2$ structure dispersed as an essential strengthening phase in a matrix.

2. A method for manufacturing the heat-resistant material defined in claim 1 comprising: heat-treating the Rh-based alloy at a temperature of 900 to 1700° C.; and precipitating at least a γ' phase having an $L1_2$ structure.

3. A heat-resistant material comprising a Rh-based alloy, wherein the Rh-based alloy consists of Rh, Al, W, and one or more Group I additive elements, wherein Rh is present in an amount of 50 mass % or more, Al is present in an amount of 0.2 to 15.0 mass %, W is present in an amount from 15.0 to 45.0 mass %, and the one or more Group I additive elements are present in a total amount of 0.001 to 2.0 mass %; and a γ' phase ($Rh_3$(Al, W)) having an $L1_2$ structure dispersed as an essential strengthening phase in a matrix, wherein the one or more Group I additive elements has been selected from the following:

Group I:
B: 0.001 to 1.0 mass %,
C: 0.001 to 1.0 mass %,
Mg: 0.001 to 0.5 mass %,
Ca: 0.001 to 1.0 mass %,
Y: 0.01 to 1.0 mass %,
La or a misch metal: 0.01 to 1.0 mass %.

4. A method for manufacturing a heat-resistant material defined in claim 3 comprising: heat-treating the Rh-based alloy at a temperature of 900 to 1700° C.; and precipitating at least a γ' phase having an $L1_2$ structure.

5. A heat-resistant material comprising a Rh-based alloy, wherein the Rh-based alloy consists of Rh, Al, W, and one or more Group II additive elements, wherein Rh is present in an amount of 50 mass % or more, Al is present in an amount of 0.2 to 15.0 mass %, W is present in an amount from 15.0 to 45.0 mass %, and the one or more Group II additive elements are present in a total amount of 0.1 to 34.8 mass %; and a γ' phase (Rh, $X)_3$(Al, W, Z) having an $L1_2$ structure dispersed as an essential strengthening phase in a matrix, wherein X comprises one or more of Co, Fe, Cr, Rh, Re, Pd, Pt and Ru; Z comprises one or more of Mo, Ti, Nb, Zr, V, Ta and Hf, and Ni is included in both X and Z, wherein the one or more Group II additive elements has been selected from the following:

Group II:
Ni: 0.1 to 34.8 mass %,
Co: 0.1 to 34.8 mass %,
Cr: 0.1 to 15 mass %,
Fe: 0.1 to 2.0 mass %,
Mo: 0.1 to 15 mass %,
Ti: 0.1 to 10 mass %,
Nb: 0.1 to 15 mass %,
Ta: 0.1 to 25 mass %,
V: 0.1 to 20 mass %,
Zr: 0.1 to 15 mass %,
Hf: 0.1 to 25 mass %,
Re: 0.1 to 25 mass %,
Pd: 0.1 to 15 mass %,
Pt: 0.1 to 25 mass %,
Ru: 0.1 to 15 mass %.

6. A method for manufacturing a heat-resistant material defined in claim 5 comprising: heat-treating the Rh-based alloy at a temperature of 900 to 1700° C.; and precipitating at least a γ' phase having an $L1_2$ structure.

7. A heat-resistant material comprising a Rh-based alloy, wherein the Rh-based alloy consists of Rh, Al, W, one or more Group I additive elements, and one or more Group II additive elements, wherein Rh is present in an amount of 50 mass % or more, Al is present in an amount of 0.2 to 15.0 mass %, W is present in an amount from 15.0 to 45.0 mass %, the one or more Group I additive elements are present in a total amount of 0.001 to 2.0 mass %, and the one or more Group II additive elements are present in a total amount of 0.1 to 34.799 mass %; a γ' phase ($Rh_3$(Al, W)) having an $L1_2$ structure dispersed as an essential strengthening phase in a matrix; and a γ' phase (Rh, $X)_3$(Al, W, Z) having an $L1_2$ structure dispersed as an essential strengthening phase in a matrix, wherein X comprises one or more of Co, Fe, Cr, Rh, Re, Pd, Pt and Ru; Z comprises one or more of Mo, Ti, Nb, Zr, Ta and Hf, and Ni is included in both X and Z, wherein the one or more Group I additive elements has been selected from the following:

Group I:
B: 0.001 to 1.0 mass %,
C: 0.001 to 1.0 mass %,
Mg: 0.001 to 0.5 mass %,
Ca: 0.001 to 1.0 mass %,
Y: 0.01 to 1.0 mass %,
La or a misch metal: 0.01 to 1.0 mass %, and wherein the one or more Group II additive elements has been selected from the following:

Group II:
Ni: 0.1 to 34.799 mass %,
Co: 0.1 to 34.799 mass %,
Cr: 0.1 to 15 mass %,
Fe: 0.1 to 20 mass %,
Mo: 0.1 to 15 mass %,
Ti: 0.1 to 10 mass %,
Nb: 0.1 to 15 mass %,
Ta: 0.1 to 25 mass %,
V: 0.1 to 20 mass %,
Zr: 0.1 to 15 mass %,
Hf: 0.1 to 25 mass %,
Re: 0.1 to 25 mass %,
Pd: 0.1 to 15 mass %,
Pt: 0.1 to 25 mass %,
Ru: 0.1 to 15 mass %.

8. A method for manufacturing a heat-resistant material defined in claim 7 comprising: heat-treating the Rh-based alloy at a temperature of 900 to 1700° C.; and precipitating at least a γ' phase having an $L1_2$ structure.

* * * * *